United States Patent [19]

Bobbio

[11] 4,174,737

[45] Nov. 20, 1979

[54] MECHANICAL DEVICE FOR MOVING THE LIFTERS OF THE WEAVING MACHINES

[76] Inventor: Benedetto Bobbio, Via Giotta, 8, Rovellasca (Como), Italy

[21] Appl. No.: 889,245

[22] Filed: Mar. 23, 1978

[30] Foreign Application Priority Data

Mar. 31, 1977 [IT] Italy ..... 21927 A/77

[51] Int. Cl.[2] ..... D03C 3/06

[52] U.S. Cl. ..... 139/65

[58] Field of Search ..... 139/55.1, 59, 64, 65, 139/82, 85

[56] References Cited

U.S. PATENT DOCUMENTS 802,938 10/1905 Naylor ..... 139/65

FOREIGN PATENT DOCUMENTS 1535220 12/1970 Fed. Rep. of Germany ..... 139/59
1936227 8/1971 Fed. Rep. of Germany ..... 139/59
433139 9/1967 Switzerland ..... 139/65
375328 6/1973 U.S.S.R. ..... 139/65

*Primary Examiner*—Henry Jaudon
*Attorney, Agent, or Firm*—Bucknam and Archer

[57] ABSTRACT

The invention covers a mechanical device for moving, upwardly and downwardly, the lifters of a weaving machine and comprises two horizontal bars provided, at the respective adjacent sides, with a series of cantilevered parallel teeth inserted into one another and with vertical guides sliding in respective seats fixed to the side walls of the device. Each horizontal bar is connected to a connecting rod which is eccentrically pivoted to a rotating disc by means of a plate. The rotating disc is provided with a graduated sector having a radial slot so that it is possible to vary the movement of the two horizontal bars. Vertical bars are fixed to the horizontal bars and the free end of the vertical bars slides in a guide which is provided on each side wall of the device. The guides have a slanted vertical axis. The vertical bars are preferably of "T" shape.

5 Claims, 7 Drawing Figures

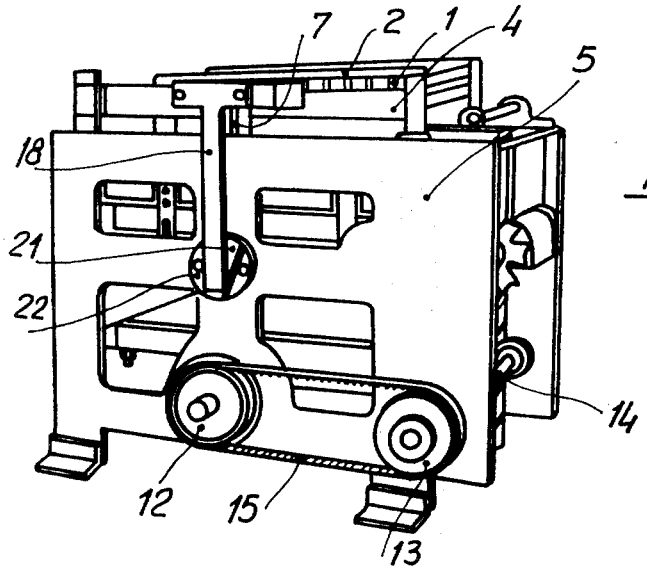
FIG. 1
FIG. 2
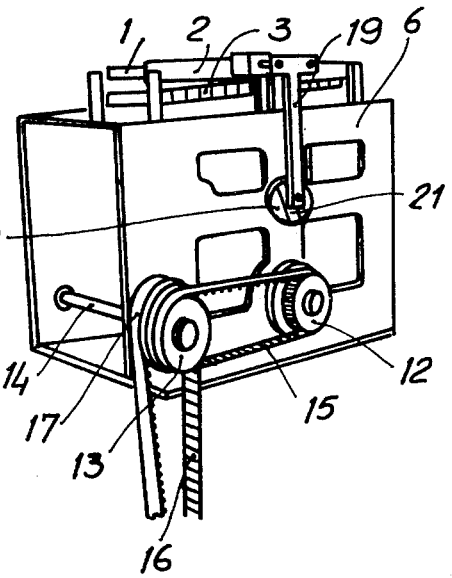
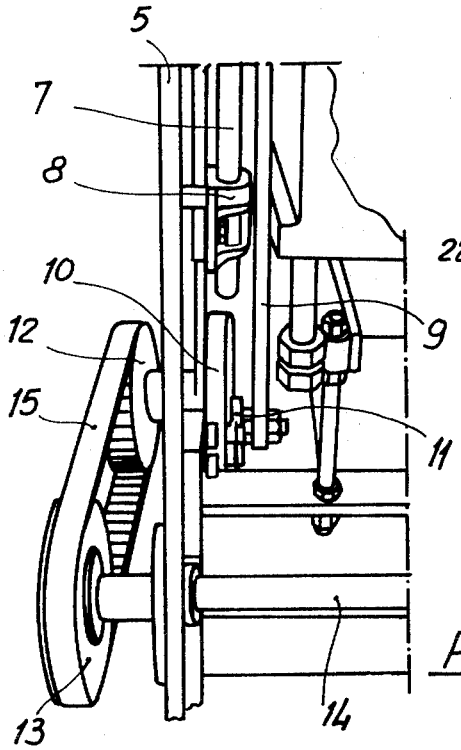
FIG. 3

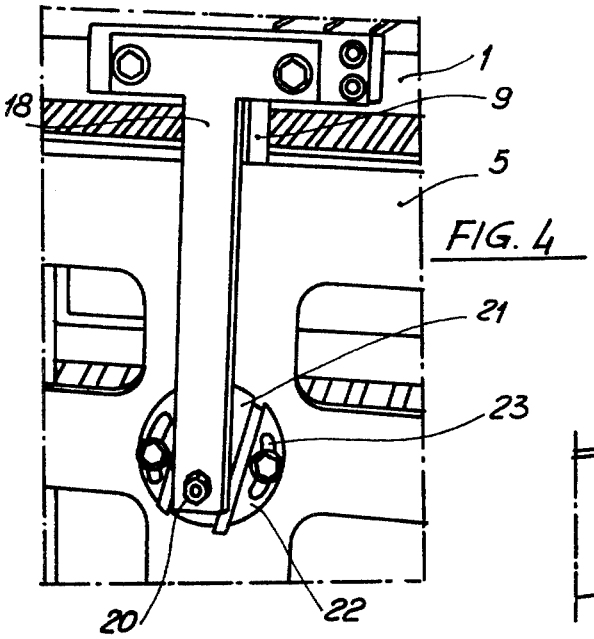
FIG. 4
FIG. 5
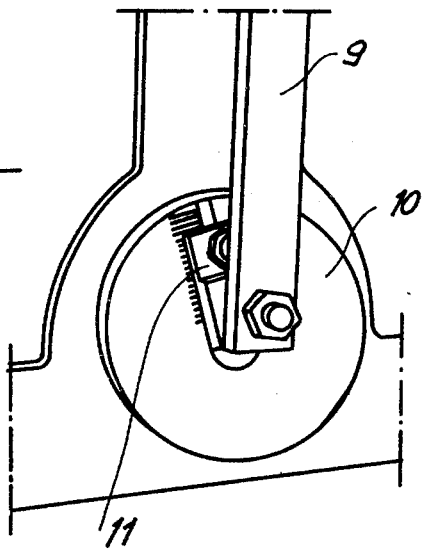
FIG. 6
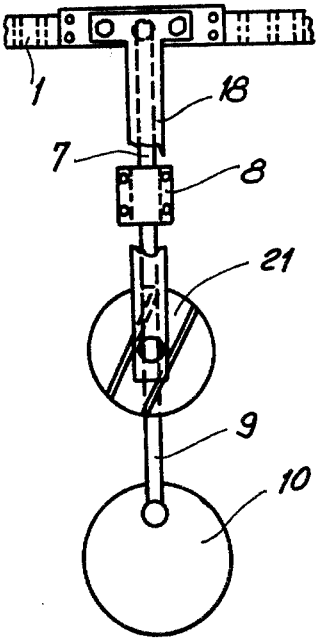
FIG. 7
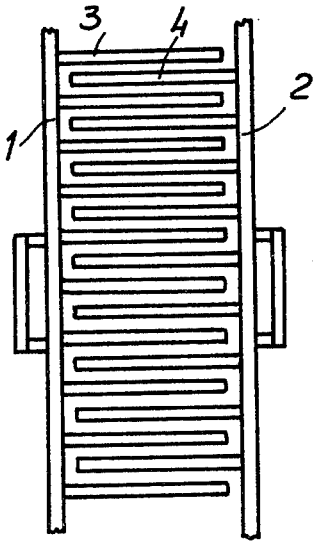

MECHANICAL DEVICE FOR MOVING THE LIFTERS OF THE WEAVING MACHINES

The present invention relates to a mechanical device or assembly for moving the lifters of weaving machines. More specifically, the present invention relates to a mechanical device or assembly effective to drive the warp threads to form the shed in a weaving machine.

As it is known, in order to produce figured cloth, the looms are provided with a device driving the lifters to which the warp threads are fixed, in order to form the shed.

Said device comprises, substantially, a plurality of shaped-needle rows, or lifters, as carried by corresponding transversal rods, and being capable of alternatively moving upwardly and downwardly.

Said grids, are of rather intricate structure, due to the fact that said transversal rods stretched with respect to one another, have to move on parallel vertical planes, during this translation said rods crossing one another at flanked positions.

Moreover said grids are normally stressed at both the sides thereof by pairs of rods which are eccentrically mounted with respect to corresponding pairs of driven wheels.

Accordingly the motion transmission to said device requires a plurality of kinematic members to be used, which cause said device to be intricate and the maintaining of the driving equipment to be difficut.

It is an object of the present invention to provide a mechanical device or assembly effective to move the warp threads, for forming the warp shed, in a weaving machine, said mechanical device being free of the aforesaid practical and structural drawbacks.

According to the present invention, these and other objects, which will become more evident from the following description, are achieved by using a mechanical device or assembly comprising two horizontal bars provided, at the respective opposed sides, with a series of cantilevered teeth which are parallel to and inserted into one another, and with vertical guides sliding in respective seats fixed to the side walls of the device, each horizontal bar being from one hand articulated to a connecting rod which is eccentrically pivotated to a rotating disc, and, from the other hand, fixed to a vertical bar end the opposite free end of which slides in a vertical guide as provided on each side wall of the device and having its longitudinal axis slanted with a variable slant. In particular, each horizontal bar is coupled to the side walls of the device by cylindrical or prismatic guides, effective to slide along suitable seats, vertically located, on said side walls.

The connecting rods are pivoted to the disc at symmetrical points, with respect to the centre of said discs, thereby the connecting rods located on opposite sides of the machine move in opposing directions so that the bars move oppositely.

In order to pivot the connecting rod to the disc, this latter is provided with a graduated sector having a radial slot in which a small plate rigid with said connecting rod is fixed at the desired position. Each disc is coupled to a toothed pulley located outwardly from the side walls of the device and the movement is transmitted to said toothed pulley by the loom motor by means of toothed belts.

The vertical bar, at the end of which said horizontal bar is fixed, is preferably of "T" shape, and has its lower free end provided with a bearing sliding in the vertical guide having a slanted longitudinal axis.

Each vertical guide is preferably provided at one side or face of a disc element in turn provided with perimetral slots and fixed to the side wall of the device by bolts extending through said slots.

The particular articulated jointing of each horizontal bar respectively to a connecting rod eccentrically pivoted to a disc and a vertical bar, the end of which slides in a slanted longitudinal axis vertical guide, allows each said horizontal bar, during the vertical translation thereof, to swing about a horizontal axis and to assume the maximum slant at the end of stroke terminal positions.

This particular arrangement of the horizontal bars at the end of stroke positions allows a greater opening of the warp threads and hence of the shed to be obtained, the translation of the horizontal bars being the same.

The characteristics of functional and structural nature of the mechanical device or assembly for moving the lifters of the weaving machine according to the present invention will become more apparent from the following description in which reference is made to the accompanying drawing figures illustrating an exemplificative and not limitative preferred embodiment of the present invention and where:

FIG. 1 is a perspective side view of a generic shed forming machine as provided with the instant mechanical device or assembly;

FIG. 2 is a perspective view of the opposing side of the FIG. 1 machine;

FIG. 3 is a front perspective view of the machine of the preceding figures;

FIG. 4 is a detailed view of the "T"-shaped bar and the linear vertical guide in which the end of said bar slides;

FIG. 5 is a detailed view of the disc to which the connecting rod is eccentrically pivoted;

FIG. 6 is a schematic view of the gearing for moving the horizontal bars, and FIG. 7 is a top view of the horizontal bars.

Referring particularly to the accompanying drawing figures, the instant mechanical device or assembly for vertically moving the lifters of the weaving machine for forming the warp shed comprises two parallel horizontal bars 1 and 2 which carry at the facing sides thereof a series of parallel cantilevered teeth indicated respectively by 3 and 4.

More specifically said teeth are suitably spaced from one another and are alternatively located on the bars, thereby each tooth of a bar is located between two adjacent teeth of the other bar and viceversa.

The horizontal bars 1 and 2 are each pivotally connected along horizontal axes to the ends of a pair of vertically extending guide rods 7 which are slidingly mounted in guide seats 8 fixed to the inner side of walls 5 and 6. The seats 8, along with rods 7, guide bars 1 and 2 through vertical reciprocating movement.

Each bar 1 and 2 is translated upwardly and downwardly, alternatively, by a connecting rod 9, eccentrically pivoted to a disc 10. Connecting rods 9 are also pivotally connected to bars 1 and 2 at their upper ends along the referred to horizontal axis.

The reciprocating is preferably obtained by a small plate 11 fixed to the connecting rod 9 and fitted to be locked at the desired position along a sector of a disc 10 provided with a radial slot and suitably graduated, thereby it is possible to vary, within limits, the translation movement of the bars 1 and 2.

The discs 10 are coupled to toothed pulleys 12 which are located outwardly from the walls 5 and 6 at one vertical horizontal axis. The units comprising discs 10 and pulley 12 are provided on each side of the frame, as shown in FIGS. 1 and 2.

Said toothed pulleys 12 are driven by the pulleys 13 fixed to the ends of a shaft 14 by means of toothed belts 15.

The motion is transmitted to the shaft 14, through a toothed belt 16 and a further pully 17 rigid with the shaft 14 by a generic shaft, which may be a driving or a driven shaft, of the underlying textile loom (not shown in the figure).

"T"-shaped bars 18 and 19 respectively are rigid with each said bar 1 and 2, said "T"-shaped bars being located almost vertically, at the outside of the walls 5 and 6 respectively of the device.

Each said vertical bar 18 and 19 is provided, at the lower end thereof, with a bearing 20 sliding along a rectilinear vertical guide 21 provided on the outer side of each wall 5 and 6 and having a slanted longitudinal axis, the slant being variable.

Accordingly, horizontal bars 1 and 2 during the rising and lowering movements pivot about horizontal axis in opposing directions due to bearings 20 following the slant of guide slots 21.

Preferably, the rectilinear guides 21 are provided on the face or side of the disc-shaped element 22 having perimetral slots 23 and fixed to the walls 5 and 6 by bolts extending through said slots.

Owing to this expedient, said guides 21 may assume any desired slant, in order to vary the deflection angle of the comb bars 1 and 2, depending on the needs and thereby varying the shed opening.

From the above description and the several figures of the accompanying drawings, the great functionality and facility of use of the mechanical device or assembly according to the present invention for moving the textile loom weaving machine lifters are self-evident.

Obviously in the practical making of the instant mechanical assembly, several variations and modifications may be brought about within the teachings of the present invention and without departing from the scope thereof.

I claim:

1. In a weaving machine, which comprises lifters, a mechanical device or assembly for moving, upwardly and downwardly, said lifters, which comprises two horizontal bars provided, at the respective adjacent sides, with a series of cantilevered parallel teeth inserted into one another and with vertical guides sliding in respective seats fixed to the side walls of the device; each horizontal bar being articulated to one end of a connecting rod which is at its opposite end eccentrically pivoted to a rotating disc, each horizontal bar being also fixedly connected to one end of a vertically extending bar, the free end of which slides in a guide provided on each side wall of the device and having its longitudinal axis slanted with a variable slant.

2. A mechanical device or assembly according to claim 1, wherein said rotating disc is provided with a graduated sector having a radial slot in which a plate is fixed, said plate being rigid with said connecting rod.

3. A mechanical device according to claim 1, wherein said vertical bar is of "T" shape and in that its lower end is provided with a bearing sliding in the vertical guide provided on each weaving machine side wall and having its longitudinal axis slanted, said slant being variable.

4. A mechanical device according to claim 1 wherein each vertical guide is provided onto the face of a disc element provided with perimetral slots and fixed to the weaving machine side wall by bolts extending through said slots.

5. A mechanical device or assembly according to claim 1 wherein each said rotating disc is coupled to a toothed pulley driven by the textile loom motor through intermediate pulleys connected to one another by toothed belts.

* * * * *